US007775850B2

(12) United States Patent
Todokoro

(10) Patent No.: US 7,775,850 B2
(45) Date of Patent: Aug. 17, 2010

(54) WATER TOY

(75) Inventor: Shinji Todokoro, Tokyo (JP)

(73) Assignee: Agatsuma Co., Ltd., Tokyo (JP)

( * ) Notice: Subject to any disclaimer, the term of this patent is extended or adjusted under 35 U.S.C. 154(b) by 111 days.

(21) Appl. No.: 12/045,599

(22) Filed: Mar. 10, 2008

(65) Prior Publication Data

US 2008/0227364 A1 Sep. 18, 2008

(30) Foreign Application Priority Data

Mar. 14, 2007 (JP) ..... 2007-065323

(51) Int. Cl.
*A63H 23/10* (2006.01)

(52) U.S. Cl. ..... 446/217; 446/177; 446/156; 446/159; 446/167; 446/176; D21/819

(58) Field of Classification Search ..... 446/217, 446/166, 153, 89, 168, 176, 177, 180, 171, 446/267, 197, 236, 156, 159, 167; 472/117
See application file for complete search history.

(56) References Cited

U.S. PATENT DOCUMENTS 3,562,950 A * 2/1971 Genin ..... 446/236
4,778,430 A * 10/1988 Goldfarb et al. ..... 446/167
6,527,613 B2 * 3/2003 Weber ..... 446/177

FOREIGN PATENT DOCUMENTS

JP 3039377 U 7/1997
JP 3098450 U 3/2003

* cited by examiner

*Primary Examiner*—Gene Kim
*Assistant Examiner*—Amir Klayman
(74) *Attorney, Agent, or Firm*—The Marbury Law Group PLLC

(57) ABSTRACT

To provide a water toy with which infants can play joyfully in a bathroom, which is easy to be fixed in place and which prevents the infants from losing their interests in playing therewith, there is provided a water toy including a pedestal portion having a pump, a circular cylindrical shaped column fixed to an upper portion of the pedestal portion, which includes a water flowing tube in an interior and a water outlet port at an upper end thereof, a spiral water flowing rail fixed to a circumferential edge of the column, a first water flowing rail detachably coupled to a lower end of the spiral water flowing rail, which includes a windmill portion having a rotor turned by using a flow of water, a second water flowing rail detachably coupled to a lower end of the first water flowing rail while being fixed onto an auxiliary fixing base, a third water flowing rail detachably coupled to a lower end of the second water flowing rail, a fourth water flowing rail detachably coupled to a lower end of the third water flowing rail, and a sliding element which slides on water flowing surfaces of the respective rails.

3 Claims, 5 Drawing Sheets

WATER TOY

CROSS-REFERENCE TO RELATED APPLICATIONS

The present application is based on and claims the benefit of priority from the prior Japanese Patent Application No. 2007-065323, filed on Mar. 14, 2007; the entire contents of which are incorporated herein by reference.

BACKGROUND OF THE INVENTION

1. Technical Field

The present invention relates to a water toy which is played with using water.

2. Background Art

Conventionally, there are sold many toys with which children can play in bathrooms or swimming pools. For example, figures floating in the water or toys driven by motors to move on the surface of water are most popular in such water toys. In recent years, owing to the advancement of manufacturing and development technologies of toys, there have been developed many toys with children, who tend to get tired easily and grow soon, can play for a long period of time.

For example, Japanese Utility Model Registration No. 3039377 proposes a toy in which there is provided a water tank having a draincock in a bottom portion, and water stored in the water tank is discharged from the draincock towards a waterwheel to cause it to turn, whereby a plurality of operating portions which are linked with the waterwheel are caused to operate in association with turns of the waterwheel.

In addition, Japanese Utility Model Registration No. 3098450 proposes a toy to be played with in a bathroom or the like in which water held in a bathtub is pumped up by an electric pump so as to be discharged from a discharge port, a tap or a shower nozzle which is attached to the toy so that the player can have a shower of the bathtub water.

SUMMARY OF THE INVENTION

An object of the present invention is to provide a water toy with which an infant can play joyfully in a both room or the like, which is easy to be fixed in place when played with and of which the infant gets reluctant to be tired.

According to the present invention, there is provided a water toy (1) including a pedestal portion (2) which includes a pump, a column (3) which is formed into a circular cylindrical shape, which includes a water flowing tube in an interior and a water outlet port (31) at an upper end thereof and which is adapted to be fixed to an upper portion of the pedestal portion (2) in such a manner as to extend upwards, a spiral water flowing rail (4) which is formed into a spiral shape and which is adapted to be fixed to a circumferential edge of the column (3), a first water flowing rail (5) which includes a windmill portion (101) having a rotor (108) adapted to be turned by a flow of water and which is adapted to be detachably coupled to a lower end of the spiral water flowing rail (4), a second water flowing rail (6) which is adapted to be detachably coupled to a lower end of the first water flowing rail (5) while being fixed onto an auxiliary fixing base (61), a third water flowing rail (7) which is adapted to be detachably coupled to a lower end of the second water flowing rail (6), a fourth water flowing rail (8) which is adapted to be detachably coupled to a lower end of the third water flowing rail (7), and a sliding element (15) which is adapted to slide on water flowing surfaces (41) of the respective rails.

According to the invention, the water toy can be provided which is convenient for carriage and which enables the replacement of the rails with other ones, since the rails are adapted to be easily coupled to and decoupled from each other.

In addition, the water toy is characterized in that the pedestal portion (2) and the auxiliary fixing base (61) have suction cups (27, 65) at a lower end thereof, the auxiliary fixing base (61) including on an upper surface thereof a vacuum fixing button (66) which is connected to an upper end of the suction cup (65) in such a manner as to be operated to create a partial vacuum to hold the suction cup (65) in a fixing place of the water toy.

According to the invention, the water toy can be strongly fixed to an edge portion of a bathtub so as to prevent the water toy from sliding off the bathtub while being played with.

Furthermore, the water toy is characterized in that the first water flowing rail (5) has the water flowing surface (41) which is formed substantially into a straight line and includes a steep sloping portion (55) which slopes steeply from the vicinity of a central portion towards the lower end thereof, a cut-out portion (56) being formed in a portion of the water flowing surface (41) which corresponds to the steep sloping portion (55), a waterwheel setting portion (57) being provided in a lower portion of the cut-out portion (56), a plurality of circular projections (58) being provided on a portion of the water flowing surface (41) which lies in the vicinity of the central portion and which slopes less steeply.

According to the invention, the flow direction and flow rate of water which flows on the water flowing surface of the first water flowing rail can be controlled so that water is allowed to flow towards a rotor driving waterwheel (102).

In addition, the water toy is characterized in that the windmill portion (101) has a rotor driving waterwheel (102) which includes a spur gear (103) at one end of a center shaft thereof and which is set in the waterwheel setting portion (57), a drive shaft (106) which includes at one end a crown gear (104) which meshes with the spur gear (103) which is provided on the center shaft of the rotor driving waterwheel (102) and a spur gear (105) at the other end thereof, the rotor (108) which includes a crown gear (107) provided at one end of a center shaft of the rotor in such a manner as to mesh with the spur gear (105) provided on the drive shaft (106), and a windmill hut (109) which covers the spur gears (103, 105), the crown gears (104, 107) and the drive shaft (106), the rotor (108) being adapted to be turned by the rotor driving waterwheel (102) being turned by a flow of water.

According to the invention, the rotor (108) can be provided which is caused to turn by the flow of water, thereby making it possible to provide the toy which interests infant players.

In addition, the water toy is characterized in that miniature models of houses which appear in cartoons popular among infants are disposed at an upper end of the column (3), at an upper end of the auxiliary fixing base (61) and in a predetermined position of the fourth water flowing rail (8), and that the face of a character which appears in the cartoons is drawn on the sliding element (15).

According to the invention, the water toy (1) can be provided which allows an infant who plays therewith to have an illusion as if he or she were playing with the character.

In this way, according to the invention, the water toy can be provided with which infant players can play joyfully in a bathroom or the like, which is easy to be fixed and which prevents the infant players from losing their interests in playing therewith.

DESCRIPTION OF THE PREFERRED EMBODIMENT

Figure 1:
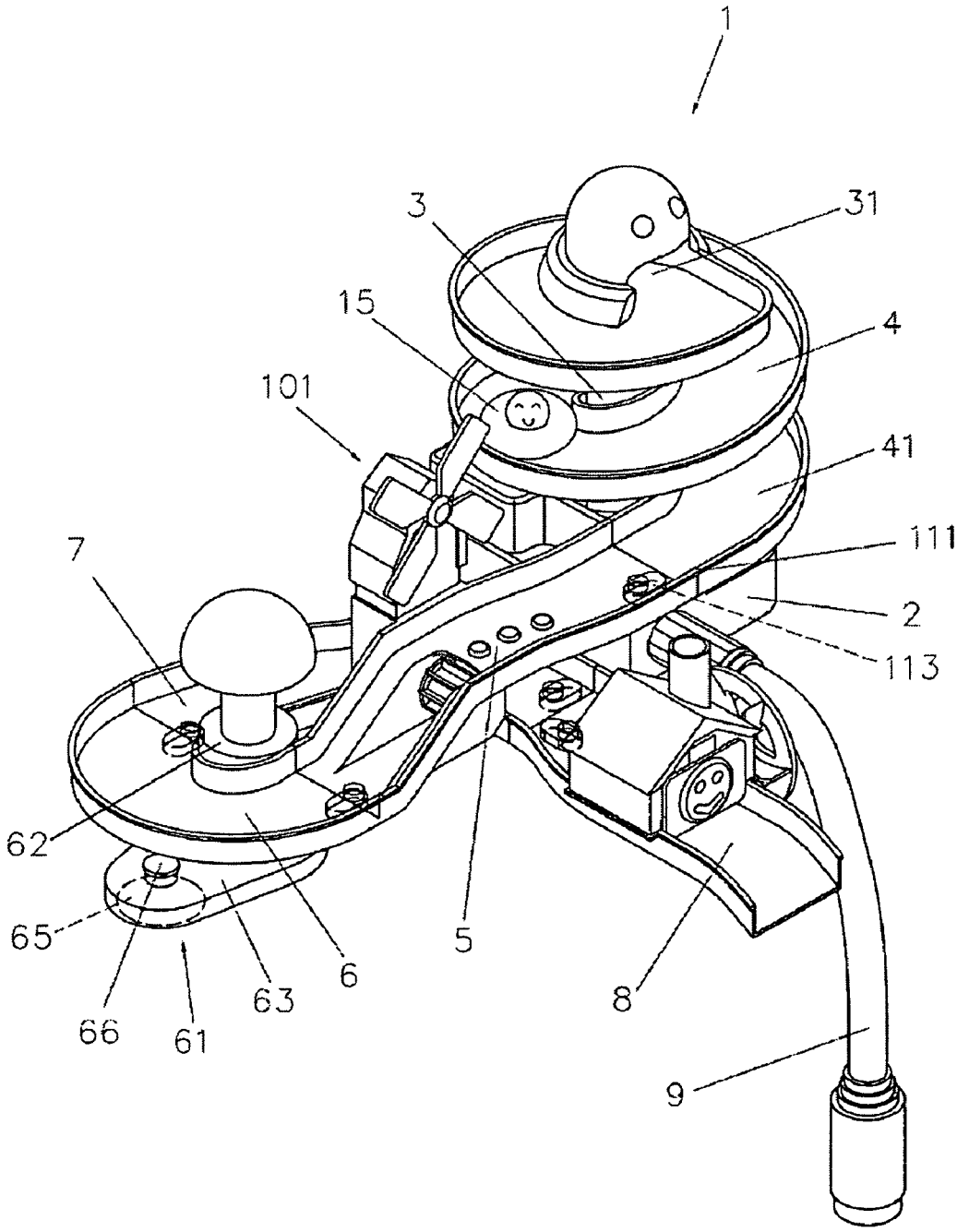
FIG. 1 is a perspective view of a water toy according to an embodiment of the invention.

A water toy 1 according to a best mode for carrying out the invention includes a pedestal portion 2 which includes a water raising pump, a column 3 which is adapted to be fixed to an upper portion of the pedestal portion 2 in such a manner as to extend upwards, which is formed into a circular cylindrical shape and which includes a water flowing tube in an interior and a water outlet port 31 at an upper end thereof, a spiral water flowing rail 4 which is formed into a spiral shape and which is adapted to be fixed to a circumferential edge of the column 3, a substantially straight-line first water flowing rail 5 which includes a windmill portion 101 having a rotor 108 adapted to be turned by making use of a flow of water and which is adapted to be detachably coupled to a lower end of the spiral water flowing rail 4, a substantially U-shaped second water flowing rail 6 which is adapted to be detachably coupled to a lower end of the first water flowing rail 5 while being fixed onto an auxiliary fixing base 61, a substantially L-shaped third water flowing rail 7 which is adapted to be detachably coupled to a lower end of the second water flowing rail 6, a substantially straight-line fourth water flowing rail 8 which is adapted to be detachably coupled to a lower end of the third water flowing rail 7, and a sliding element 15 which is adapted to slide on water flowing surfaces 41 of the respective rails.

In addition, the pedestal portion 2 and the auxiliary fixing base 61 have suction cups 27, 65 at a lower end thereof, respectively, and the auxiliary fixing base 61 includes on an upper surface thereof a vacuum fixing button 66 which is connected to an upper end of the suction cup 65 in such a manner as to be operated to create a partial vacuum to hold the suction cup 65 in a fixing place of the water toy. In addition, the first water flowing rail 5 has the water flowing surface 41 which is formed substantially into a straight line and includes a steep sloping portion 55 which slopes steeply from the vicinity of a central portion towards the lower end thereof, a cut-out portion 56 is formed in a portion of the water flowing surface 41 which corresponds to the steep sloping portion 55, a waterwheel setting portion 57 is provided in a lower portion of the cut-out portion 56, and a plurality of circular projections 58 is provided on a portion of the water flowing surface 41 which lies in the vicinity of the central portion and which slopes less steeply.

Furthermore, the windmill portion 101 has a rotor driving waterwheel 102 which includes a spur gear 103 at one end of a center shaft thereof and which is set in the waterwheel setting portion 57, a drive shaft 106 which includes at one end a crown gear 104 which meshes with the spur gear 103 which is provided on the center shaft of the rotor driving waterwheel 102 and a spur gear 105 at the other end thereof, the rotor 108 which includes at one end of a center shaft of the rotor a crown gear 107 which meshes with the spur gear 105 provided on the drive shaft 106, and a windmill hut 109 which covers the spur gears 103, 105, the crown gears 104, 107 and the drive shaft 106, the rotor 108 being adapted to be turned by the rotor driving waterwheel 102 being turned by a flow of water.

In addition, miniature models of houses which appear in cartoons popular among infants are disposed at an upper end of the column 3, at an upper end of the auxiliary fixing base 61 and in a predetermined position of the fourth water flowing rail 8, and furthermore, the face of a character which appears in the cartoons is drawn on the sliding element 15.

Hereinafter, the water toy according to an embodiment of the invention will be described in detail based on the drawings. The water toy 1 is such as to include, as is shown in FIG. 1, the pedestal portion 2 having a pump 9, the circular cylindrical column 3 which is fixed to the upper portion of the pedestal portion 2 in such a manner as to extend upwards, the spiral water flowing rail 4 which is fixed to the circumferential edge of the column 3 in such a manner as to be wound thereround, the first water flowing rail 5 which is adapted to be detachably coupled to the lower end of the spiral water flowing rail 4 and which includes the windmill portion 101 in a predetermined position, the substantially U-shaped second water flowing rail 6 which is adapted to be detachably coupled to the lower end of the first water flowing rail 5, the substantially L-shaped third water flowing rail 7 which is adapted to be detachably coupled to the lower end of the second water flowing rail 6, the fourth water flowing rail 8 which is adapted to be detachably coupled to the lower end of the third water flowing rail 7, and the sliding element 15 which is adapted to slide on the water flowing surfaces 41 of the rail 4 to rail 8, respectively.

Figure 2:
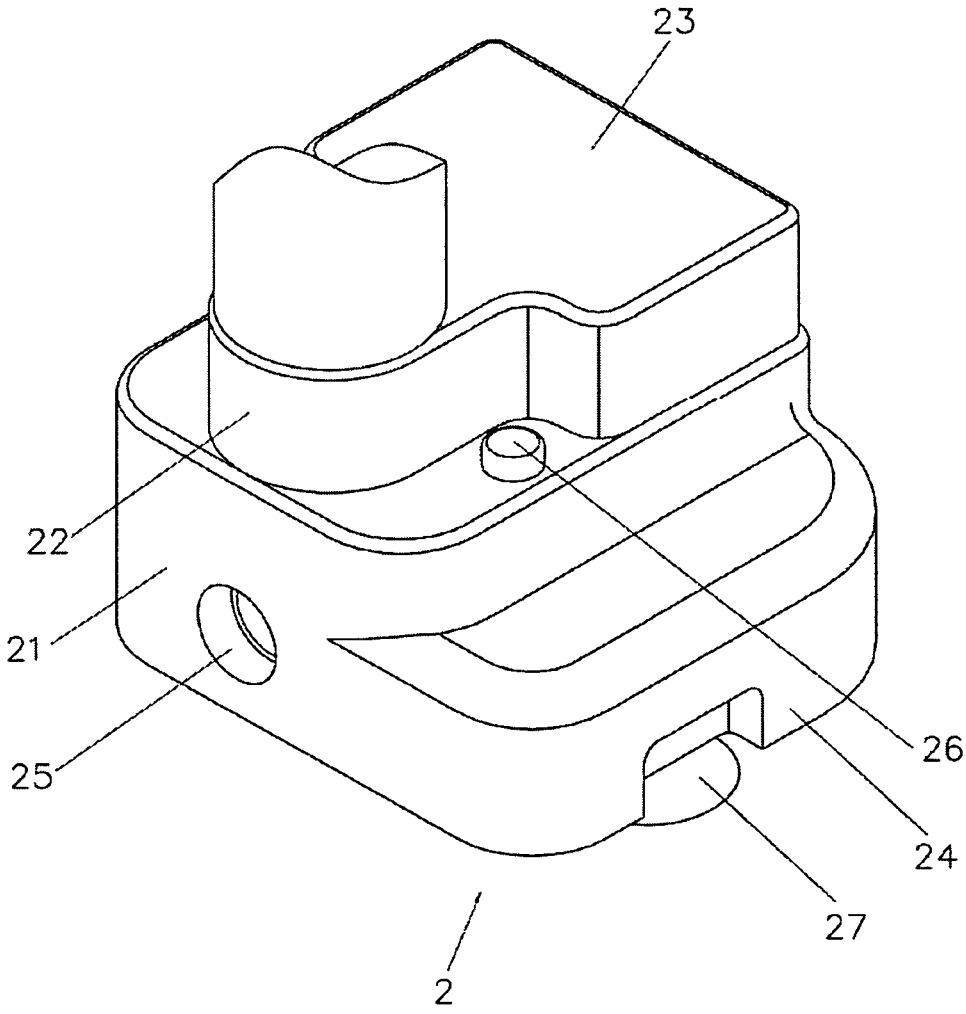
FIG. 2 is a partially enlarged perspective view of the water toy according to the embodiment of the invention.

As is shown in FIG. 2, the pedestal portion 2 is such as to include a substantially rectangular parallelepiped-shaped main body portion 21 which is chamfered at corners thereof, a circular cylindrical column fixing portion 22 which is formed on an upper surface of the main body portion 21 in the vicinity of a front surface side of the main body portion 21, a rear projecting portion 23 which is situated at the rear of the upper surface of the main body portion 21 and is formed in such a manner as to project upwards from the upper surface of the main body portion 21 and which incorporates therein a battery, and a right projecting portion 24 which is formed in such a manner as to project from a right-hand surface of the main body portion 21 to keep a balance on the pedestal portion 2 which includes the column 3.

In addition, a pump mounting portion 25 where to detachably mount the pump 9 which is a water raising pump for taking in water from a water tank such as a bathtub is formed on the front surface of the main body portion 21 of the pedestal portion 2, an activation switch 26 configured to activate the pump 9 is provided on the upper surface of the main body portion 21 in the vicinity of the column fixing portion 22, and a suction cup 27, which is used when fixing the water toy 1 to an edge of the bathtub, is provided on a bottom surface of the right projecting portion 24.

As is shown in FIG. 1, the column 3 is formed into the circular cylindrical shape and includes in an interior thereof, which is not shown, a water flowing tube through which water taken in by the pump 9 flows up to an upper end of the column 3. The column 3 also includes at the upper end thereof an outlet port 31 from which the water raised up to the upper end of the column 3 through the water flowing tube is allowed to flow out towards the water flowing surface 41 of the spiral water flowing rail 4. A miniature model of a house which appears in cartoons popular among infants is disposed above the outlet port 31.

As is shown in FIG. 1, the spiral water flowing rail 4 is a water flowing rail on which water flows and which is formed into a spiral shape, and the spiral water flowing rail 4 is coupled to the outlet port 31 of the column 3 at an upper end thereof and is fixed to the circumferential edge of the column 3 in such a manner as to be wound thereround. In addition, the spiral water flowing rail 4 has side walls which project upwards from both sides of the water flowing surface 41 so as to be formed into a U-shape which opens upwards and is mounted in such a manner as to slope slightly down towards the column 3 so as to prevent the water from being caused to flow out of the spiral water flowing rail 4 due to centrifugal force. In addition, the water flowing rails, which will be described below, also each have side walls which project upwards from both sides of the water flowing surface 41 so as to be formed into a U-shape which opens upwards.

Furthermore, a coupling portion 111 is provided at a lower end portion of the spiral water flowing rail 4 which is used when the spiral water flowing rail 4 is coupled with an upper end portion of the first water flowing rail 5. This coupling portion 111 is such as to be formed in such a manner as to prevent water from overflowing therefrom when the respective water flowing rails are coupled to each other at the coupling portion 111 and is made up of a receiving portion and an inserted portion, and the receiving portion of the coupling portion 111 is formed at the lower end portion of the spiral water flowing rail 4.

In addition, although not illustrated, the inserted portion of the coupling portion 111 is such that a strap-like flange portion is formed on an outer circumferential edge of the rail end portion, while the receiving portion of the coupling portion 111 is formed thick at the rail end portion and is configured to have a groove formed in the thick portion in such a manner as to receive therein the flange portion formed on the inserted portion. In addition, the first water flowing rail 5 has a rotatably fastening device 113 on a back surface of the water flowing surface 41 in the vicinity of the inserted portion, so that the fastening device 113 formed on the back surface side of the water flowing surface 41 in the vicinity of the inserted portion is rotated after inserting the flange portion formed on the inserted portion into the groove formed in the receiving portion, and the thick portion which constitutes the end portion of the water flowing rail where the receiving portion is provided is held between the fastening device 113 and the end portion of the water flowing rail where the inserted portion is provided, whereby the respective water flowing rails are coupled and fixed to each other.

Figure 3:
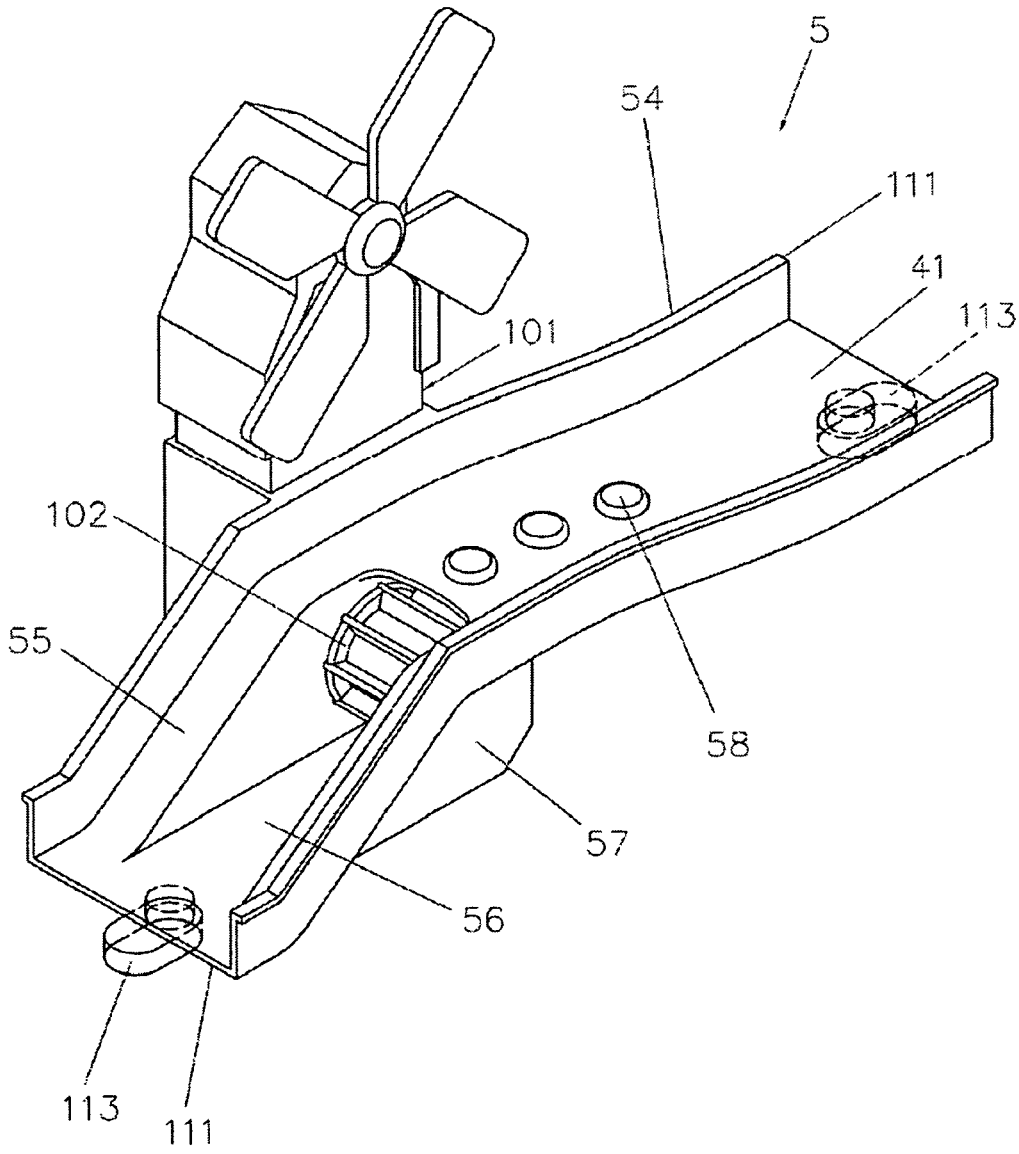
FIG. 3 is an enlarged perspective view of a first water flowing rail of the embodiment of the invention.

As is shown in FIG. 3, this first water flowing rail 5 is a water flowing rail which is formed substantially into a straight line, has a curved portion 54 where a central axis of the water flowing portion 41 is slightly curved to snake between an upper end to the vicinity of a center thereof and includes a steep sloping portion 55 which is formed to extend from the vicinity of the center to the lower end thereof so as to make up a portion where water is caused to flow down abruptly as if it fell. In addition, a cut-out portion 56 is formed in a central portion of the water flowing surface 41 which lies to extend from the vicinity of an upper end of the steep sloping portion 55 to the lower end of the first water flowing rail 5.

Additionally, the first water flowing rail 5 has a waterwheel setting portion 57 on a back surface side of the steep sloping portion 55 which slopes steeply. This waterwheel setting portion 57 is where to set a rotor driving waterwheel 102, which will be described later, and is made up of a rear wall which is formed to extend downwards from a portion on the back surface side of the water flowing surface 41 which lies in the vicinity of an upper end of the cut-out portion 56 and which has a width which is substantially the same as the width of the cut-out portion 56, a bottom wall which links a lower end of the rear wall with a lower end of the cut-out portion 56 and has a width which is substantially the same as the width of the cut-out portion 56, and triangular side walls which link sides of the rear wall and the bottom wall with side edges of the cut-out portion 56, whereby the waterwheel setting portion 57 is formed into a substantially triangular prism-shaped space which is opened on a side where the cut-out portion 56 is situated so as to prevent the overflow of water which has been used to turn the rotor driving waterwheel 102 provided on the waterwheel setting portion 57.

Furthermore, a plurality of circular projections 58 are formed at predetermined intervals on a portion of the water flowing surface 41 which slopes less steeply from the vicinity of the curved portion 54 to the vicinity of the upper end of the steep sloping portion 55. These circular projections 58 are formed so as not only to suppress the flow rate of water which has flowed through the spiral water flowing rail 4 but also to control water which has flowed through the spiral water flowing rail 4 in such a way that the water flows along the vicinity of the center of the water flowing surface 41. The circular projections 58 can control together with the curved portion 54 the flow of water which flows on the first water flowing rail 5 in such a way that water flows along the vicinity of the center of the water flowing surface 41 in the steep sloping portion 55 and can reduce the flow rate of water before it flows into the steep sloping portion 55. In addition, top surfaces of the circular projections 58 are made into flat surfaces so as not to constitute an interruption to the passage of the sliding element 15 thereover.

In addition, an inserted portion of a coupling portion 111 which couples the first water flowing rail 5 to the second water flowing rail 6 is provided at a lower end portion of the first water flowing rail 5, and the construction of the inserted portion of the coupling portion 111 is the same as that of the inserted portion provided at the upper end of the first water flowing rail 5, and a fastening device 113 is also provided on a back surface side of the water flowing surface 41 in the vicinity of the coupling portion 111.

Figure 4:
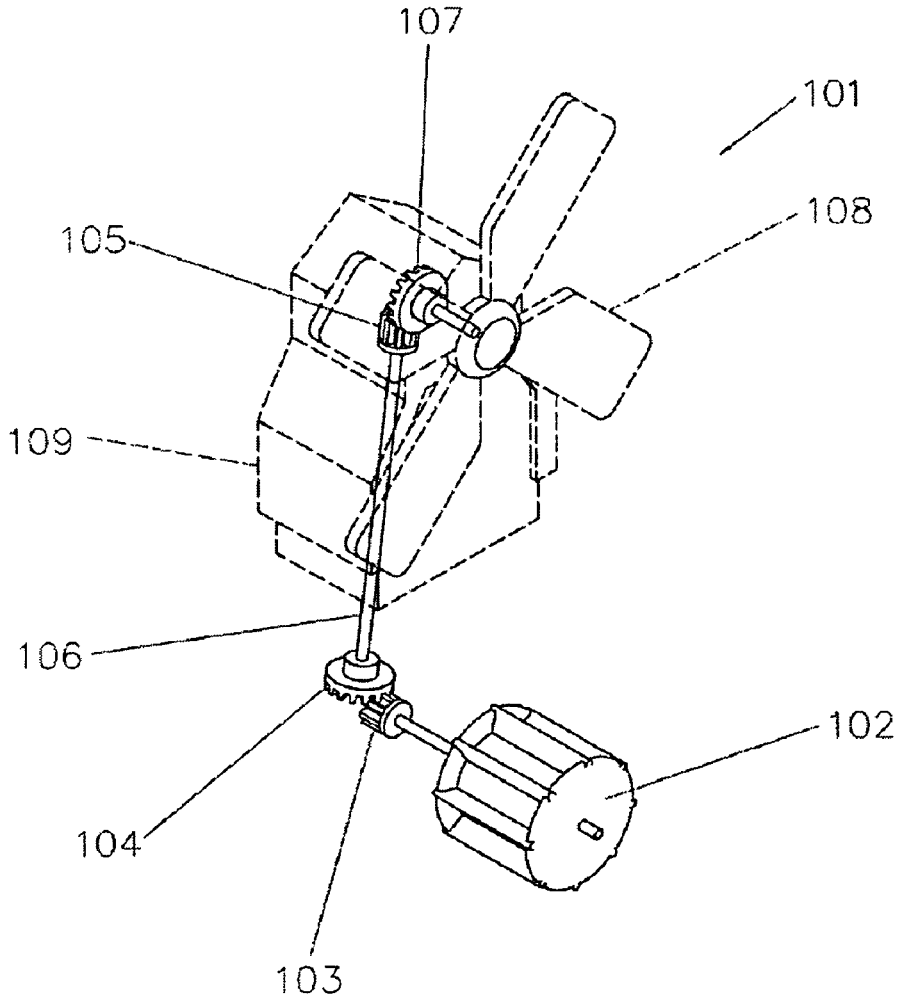
FIG. 4 is an explanatory view which illustrates the construction of a windmill portion according to the embodiment of the invention.

Additionally, as is shown in FIG. 4, the windmill portion 101 is such as to be made up of the rotor driving waterwheel 102 which includes the spur gear 103 at a leading end of the center shaft thereof, the drive shaft 106 which includes at one end the crown gear 104 which meshes with the spur gear 103 provided on the center shaft of the rotor driving waterwheel 102 and the spur gear 105 at the other end thereof, the rotor 108 which includes at a leading end of the center shaft of the rotor the crown gear 107 which meshes with the spur gear 105 provided on the drive shaft 106, and the windmill hut 109 which covers the spur gears 103, 105, the crown gears 104, 107 and the drive shaft 106.

As is shown in FIG. 1, the rotor driving waterwheel 102 of the windmill portion 101 is disposed in a position which lies in the vicinity of the upper end of the cut-out portion 56 in such a manner that vanes of the rotor driving waterwheel 102 slightly project from the water flowing surface 41, whereby water flowing into the cut-out portion 56 is made to strike the vanes of the rotor driving waterwheel 102 so as to turn the rotor driving wheel 102. In addition, when the rotor driving waterwheel 102 is turned, the crown gear 104 which meshes with the spur gear 103 provided on the center shaft of the rotor driving waterwheel 102 is turned so as to turn the drive shaft 106, and this turns the spur gear 105 provided at the other end of the drive shaft 106 to thereby turn the crown gear 107 provided on the center shaft of the rotor 108, whereby the rotor 108 is turned.

As is shown in FIG. 1, the second water rail 6 is the substantially U-shaped water flowing rail and is fixed to the auxiliary fixing base 61. The second water rail 6 includes at an upper end portion a receiving portion of a coupling portion 111 which couples the upper end portion of the second water flowing rail 6 with the lower end portion of the first water flowing rail 5, and is formed at a lower end portion of the second water flowing rail 6 a receiving portion of a coupling portion which couples the lower end of the second water flowing rail 6 with an upper end of the third water flowing rail 7.

The auxiliary fixing base 61 is such as to be formed to support the second water flowing rail 6 which lies in a location which is farthest away from the pedestal portion 2 since the rails of the water toy 1 are long, so as to maintain the stability of the water toy 1. This auxiliary fixing base 61 includes a cylindrical second water flowing rail fixing portion 62 which fixes the second water flowing rail 6 and a setting assisting portion 63 which is rotatably mounted at a lower end of the second water flowing rail fixing portion 62, and a miniature model of a predetermined character which appears in cartoons popular among infants is set on the upper portion of the second water flowing rail fixing portion 62.

In addition, the setting assisting portion 63 includes a suction cup 65 on a back side thereof, and a vacuum fixing button 66 is mounted on an upper surface side of a portion of the setting assisting portion 63 where the suction cup 65 is located in such a manner as to pass through the setting assisting portion 63 to be connected to an upper end of the suction cup 65. When this vacuum fixing button 66 is depressed in such a state that the suction cup 65 is placed in an inverted fashion on a smooth flat surface as of an edge of a bathtub, air inside the suction cup 65 escapes to the outside to create a partial vacuum so as to enhance a vacuum fixing force of the suction cup 65, whereby the water toy can strongly be fixed to the edge of the bathtub. Furthermore, since the setting assisting portion 63 is mounted rotatably at the second water flowing rail fixing portion 62, the orientation of the setting assisting portion 63 can be changed to mach a place where to set the water toy 1, thereby making it possible to set the water toy 1 in various places.

The third water flowing rail 7 is the substantially L-shaped water flowing rail and is such as to be disposed in such a manner that an upper end lies on a back side of the water toy 1 while it passes under the first water flowing rail 5 so that the lower end comes out to a front side of the water toy 1. In addition, an inserted portion of a coupling portion 111 is provided at the upper end of the third water flowing rail 7 which is coupled to the lower end of the second water flowing rail 6, and a fastening device 113 is provided in a position on a back side of the water flowing surface 41 which lies in the vicinity of the coupling portion 111, a receiving portion of a coupling portion 111 being provided at the lower end of the third water flowing rail 7 which is coupled to an upper end of the fourth water flowing rail 8.

Figure 5:
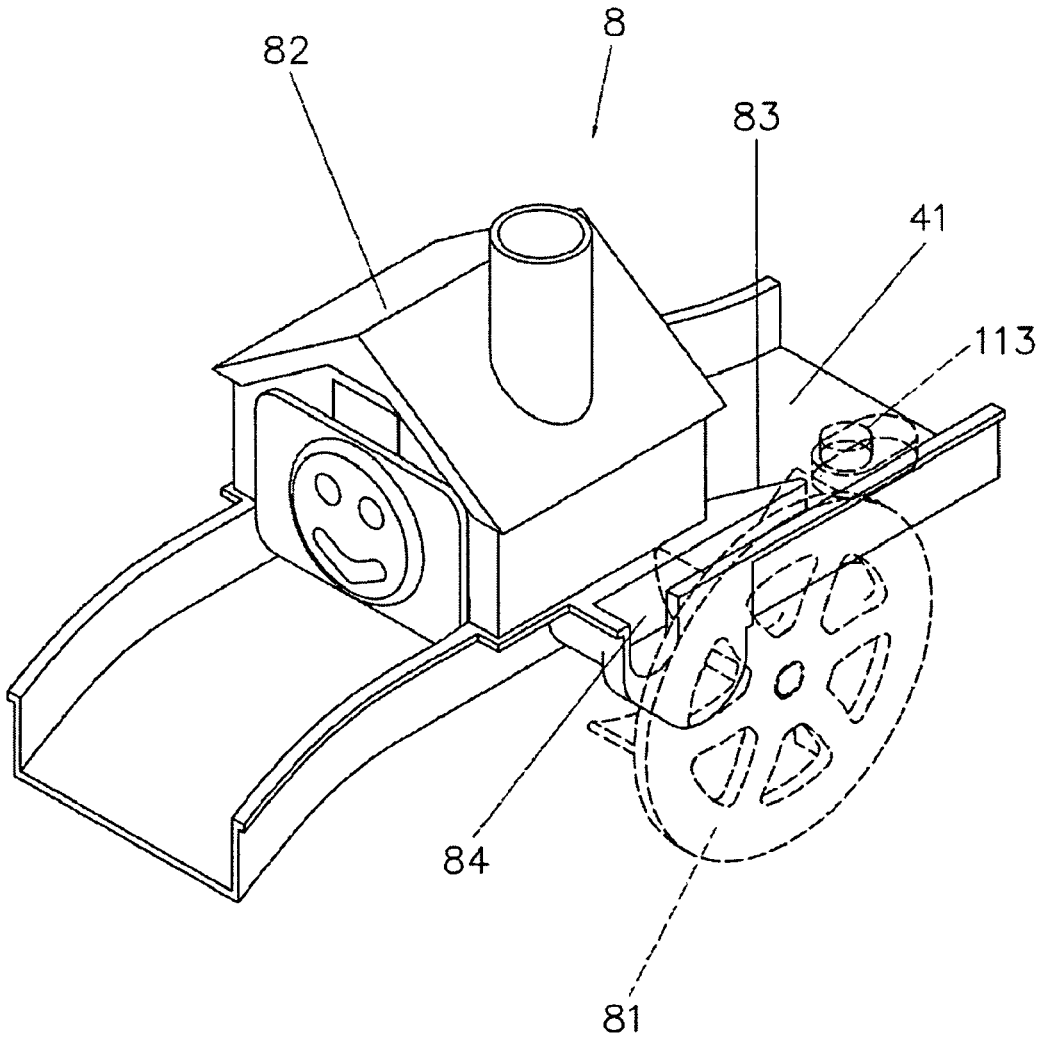
FIG. 5 is an enlarged perspective view of a fourth water flowing rail according to the embodiment of the invention.

As is shown in FIG. 5, the fourth water flowing rail 8 is the substantially straight-line water flowing rail, and a second waterwheel 81 is mounted on a right side wall thereof, and a miniature model of house 82 where a character popular among infants lives is disposed above the water flowing surface 41 in a position in the vicinity of the second waterwheel 81. This miniature model of house 82 has openings on a front surface side and a rear surface side thereof which allow the sliding element 15 to pass therethrough, and a door is provided for the opening on the front surface side in such a manner as to be rotated to open on an upper hinge.

In addition, a portion of the water flowing surface 41 which lies in the vicinity of the second waterwheel 81 is formed in such a manner as to be divided into a main water flowing rail 83 which permits a flow of water to the miniature model of house 82 where the character lives and a second waterwheel turning water flowing rail 84 which permits a supply of water to the second waterwheel 81. By forming the second waterwheel water flowing rail 84 in this way, the second waterwheel 81 is allowed to be turned by the flow of water so supplied.

The pump 9 includes a water raising pump at a distal end portion thereof and includes at the other end a detachable portion which can detachably mounted on the pump mounting portion 25 of the pedestal portion 2, and when the activation switch 26 on the pedestal portion 2 is depressed in such a state that the distal end portion of the pump 9 is submerged in water in the water tank, the pump 9 is allowed to take in water from the water tank.

The sliding element 15 is such as to be made up of a disk portion of which a bottom portion is made into a sliding surface and a spherical element which is fixed to an upper portion of the disk portion, and the face of a character popular among infants is drawn on the spherical element, and a picture of a life ring is drawn in the disk portion, so as to produce a scene of the character sliding down the water flowing rails while riding on the life ring.

In addition, since the water toy 1 of the embodiment is configured to slope down from the upper end of the spiral water flowing rail 4 to the lower end of the fourth water flowing rail 8, water is allowed to flow down accordingly, and by forming the water flowing surface 41 into the spiral shape as on the spiral water flowing rail 4 and also forming the water flowing surfaces 41 into the substantially U-shape and L-shape as on the second water flowing rail 6 and the third water flowing rail 7, the total length of the water flowing surfaces 41 is made long while suppressing the width thereof, so as to extend the sliding time of the sliding element 15, whereby the water toy 1 is configured to prevent infant players from losing their interests in playing therewith.

A playing method of the water toy 1 of the invention will be described. Firstly, the water toy 1 is placed on a corner portion of intersecting upper edges of a bathtub with the pedestal portion 2 and the auxiliary fixing base 61 brought into abutment with one and the other of the intersecting upper edges of the bathtub, respectively, so as to stabilize the water toy 1 on the bathtub. Then, the suction cups on the lower surfaces of the pedestal portion 2 and the auxiliary fixing base 61 are pressed against the corresponding upper edges of the bathtub to be fixed thereto, and the pump 9 is submerged in water in the bathtub which constitutes the water tank. Then, when the activation switch 26 is depressed in such a state that a leading end of the pump 9 is in contact with water in the bathtub, the pump 9 is activated to take in water from the bathtub which is made to constitute the water tank.

Water taken in by he pump 9 passes through the pedestal portion 2 and the water flowing tube in the column 3 to flow onto the water flowing surface 41 of the spiral water flowing rail 4 from the outlet port 31. The water then flows from the upper end to the lower end of the water flowing surface 41 of the spiral water flowing rail 4 while flowing round the circumference of the column 3 and flows into the first water flowing rail 5. The water that has flowed into the first water flowing rail 5 flows to come into a forcible contact with the side wall of the curved portion 54, whereby not only the flowing speed of the water is slowed but also the water is controlled to flow along the vicinity of the center of the water flowing surface 41 so as to flow into the cut-out portion 56.

The water that has flowed into the cut-out portion 56 comes into collision with the rotor driving waterwheel 102 to turn the rotor driving waterwheel 102, whereby the rotor 108 which is coupled to the rotor driving waterwheel 102 is turned. Furthermore, the water that has been used to turn the rotor 108 then flows through the second water flowing rail 6 and the third water flowing rail 7 to flow into the fourth water flowing rail 8. The water then is divided on the water flowing surface 41 of the fourth water flowing rail 8 to flow into the main water flowing rail 83 and the second waterwheel turning water flowing rail 84. The water that flows into the second waterwheel turning water flowing rail 84 then turns the second waterwheel 81 and thereafter falls into the water tank such as the bathtub. On the other hand, the water that has flowed into the main water flowing rail 83 flows to pass through the miniature model of house 82 from the rear opening to the front opening thereof and thereafter falls into the water tank such the bathtub.

In addition, when the player sets the sliding element 15 in the vicinity of the outlet port 31, the sliding element 15 slides along the water flowing surface 41 of the spiral water flowing rail 4 while being accelerated and rushes into the first water sliding rail 5, passing through the steep sloping portion 55 on the first water flowing rail 5 to continue sliding down along the second water flowing rail 6 and the third water flowing rail 7. The sliding element 15 then rushes into the miniature model of house 82 on the fourth water flowing rail 8 from the opening on the back side thereof and push opens the door to slidingly fall into the water tank.

INDUSTRIAL APPLICABILITY

According to the invention, by providing the suction cups 27, 65 on the lower surfaces of the pedestal portion 2 and the auxiliary fixing base 61, the water toy 1 can be provided which is easy to be fixed in place and which becomes stable once it is so fixed. Since the setting assisting portion 63 is made rotatable, the water toy 1 can be provided which can be set on any place on the wide circumferential upper edge portions of a bathtub. In addition, since the miniature models of the characters and houses which appear in cartoons popular among infants are used, the water toy 1 allows infant players to play therewith while having an illusion that they are part of the popular cartoons. Furthermore, the water toy can be provided which gets infant players interested in playing therewith by causing the rotor to turn by making use of the flow of water. In addition, the respective rails can easily be coupled to and decoupled from each other due to the provision of the coupling portions 111 at end portions of respective rails, and this makes the toy convenient for carriage, and since the sliding distance of the sliding element 15 is long, the water toy 1 can be provided which prevents infant players from losing their interests in playing therewith.

In addition, while in the embodiment the water raising pump is used as the pump 9, a suction pump can easily be made to be incorporated in the pedestal portion 2 by modifying the design of the toy, and it is natural that rails having coupling portions 111 at end portions thereof can be combined for use as replacement rails.

What is claimed is:

1. A water toy comprising:

a pedestal portion which includes a pump;

a column which is adapted to be fixed to an upper portion of the pedestal portion in such a manner as to extend upwards, which is formed into a circular cylindrical shape, and which includes a water flowing tube in an interior and a water outlet port at an upper end thereof;

a spiral water flowing rail which is formed into a spiral shape and which is adapted to be fixed to a circumferential edge of the column;

a first water flowing rail which is adapted to be detachably coupled to a lower end of the spiral water flowing rail and which includes a windmill portion having a rotor adapted to be turned by making use of a flow of water;

a second water flowing rail which is adapted to be detachably coupled to a lower end of the first water flowing rail while being fixed onto an auxiliary fixing base;

a third water flowing rail which is adapted to be detachably coupled to a lower end of the second water flowing rail;

a fourth water flowing rail which is adapted to be detachably coupled to a lower end of the third water flowing rail; and a sliding element which is adapted to slide on water flowing surfaces of the respective rails, wherein:

the pedestal portion and the auxiliary fixing base have suction cups at a lower end thereof, respectively;

the auxiliary fixing base comprises on an upper surface thereof a vacuum fixing button which is connected to an upper end of the suction cup in such a manner as to be operated to create a partial vacuum to hold the suction cup in a fixed place of the water toy;

the first water flowing rail has a water flowing surface which is formed substantially into a straight line and comprises a steep sloping portion which slopes steeply from the vicinity of a central portion towards the lower end thereof, a cut-out portion being formed in a portion of the water flowing surface which corresponds to the steep sloping portion, a waterwheel setting portion being provided in a lower portion of the cut-out portion, a plurality of circular projections being provided on a portion of the water flowing surface which lies in the vicinity of the central portion; and the windmill portion has a rotor-driving waterwheel which is set in the waterwheel setting portion and which comprises:

a spur gear provided at one end of a center shaft thereof;

a drive shaft which comprises at one end a crown gear which meshes with the spur gear provided on the rotor driving waterwheel and a spur gear at the other end thereof;

the rotor which comprises a crown gear provided at one end of a center shaft of the rotor in such a manner as to mesh with the spur gear provided on the drive shaft; and a windmill hut which covers the spur gears, the crown gears and the drive shaft, and wherein the rotor and the rotor-driving waterwheel are adapted so that the rotor is turned by the rotor-driving waterwheel which is configured to be turned by a flow of water.

2. A water toy as set forth in claim 1, wherein miniature models of houses which appear in cartoons popular among infants are disposed at an upper end of the column, at an upper end of the auxiliary fixing base and in a predetermined position of the fourth water flowing rail, and the face of a character which appears in the cartoons is drawn on the sliding element.

3. A water toy as set forth in claim 2, wherein the miniature model of a house disposed in the predetermined position of the fourth water flowing rail is disposed above a water flowing surface of the fourth water flowing rail, and has openings on a front surface side and a rear surface side of the house which allow a sliding element to pass through the miniature model of a house.

* * * * *